US007812778B2

(12) United States Patent
Hasegawa

(10) Patent No.: US 7,812,778 B2
(45) Date of Patent: Oct. 12, 2010

(54) ANTENNA APPARATUS

(75) Inventor: Minoru Hasegawa, Yokohama (JP)

(73) Assignee: Samsung Electronics Co., Ltd (KR)

( * ) Notice: Subject to any disclaimer, the term of this patent is extended or adjusted under 35 U.S.C. 154(b) by 241 days.

(21) Appl. No.: 11/964,499

(22) Filed: Dec. 26, 2007

(65) Prior Publication Data

US 2008/0150822 A1 Jun. 26, 2008

(30) Foreign Application Priority Data

Dec. 26, 2006 (JP) ..... 2006/350034
May 29, 2007 (KR) ..... 10-2007-0052289

(51) Int. Cl.
*H01Q 9/04* (2006.01)

(52) U.S. Cl. ..... 343/790; 343/837

(58) Field of Classification Search ..... 343/790, 343/791, 834, 840, 837, 802, 792, 781 P, 343/781 CA, 752
See application file for complete search history.

(56) References Cited

U.S. PATENT DOCUMENTS

| | | | | |
|---|---|---|---|---|
| 3,740,755 | A * | 6/1973 | Grenzeback | 343/840 |
| 4,982,198 | A * | 1/1991 | Shafai et al. | 343/818 |
| 6,107,973 | A * | 8/2000 | Knop et al. | 343/781 P |
| 6,184,840 | B1 * | 2/2001 | Hsin-Loug et al. | 343/781 P |
| 6,963,313 | B2 * | 11/2005 | Du | 343/790 |
| 2005/0156804 | A1 | 7/2005 | Ratni et al. | |

FOREIGN PATENT DOCUMENTS

| | | | |
|---|---|---|---|
| GB | 578 018 | | 6/1946 |
| GB | 801 886 | | 9/1958 |
| JP | 62-032711 | | 2/1987 |
| JP | 09-055620 | | 2/1997 |
| JP | 09055620 | A * | 2/1997 |
| JP | 2001-257523 | | 9/2001 |
| JP | 2001257523 | A * | 9/2001 |
| KR | 20-0295968 | | 11/2002 |
| KR | 1020030093146 | | 12/2003 |
| KR | 20-0375813 | | 2/2005 |
| KR | 1020050105785 | | 11/2005 |

* cited by examiner

*Primary Examiner*—Michael C Wimer
*Assistant Examiner*—Kyana R Robinson
(74) *Attorney, Agent, or Firm*—The Farrell Law Firm, LLP

(57) ABSTRACT

An antenna apparatus is provided, which removes dead directions, and at the same time, has a suppression means for easily suppressing the change of an antenna directivity pattern caused by the effect of a feed line or a radome and an improvement means for simply improving the VSWR deterioration caused by the effect of a reflector or the radome. The antenna apparatus includes a sleeve antenna connected to a coaxial cable and a reflector in the shape of a cone, the sleeve antenna including a central conductor and a sleeve, in which the sleeve antenna is arranged in a concave portion of the cone so that the central conductor is aligned with a central axis of the cone, and a top end of the central conductor is separate from a vertex portion of the cone.

10 Claims, 8 Drawing Sheets

ANTENNA APPARATUS

PRIORITY

This application claims priority under 35 U.S.C. §119(a) to an application entitled "Antenna Apparatus" filed in the Japanese Patent Office on Dec. 26, 2006 and assigned Serial No. 350034/2006, and filed in the Korean Intellectual Property Office on May 29, 2007 and assigned Serial No. 2007-52289, the contents of which are hereby incorporated by reference.

BACKGROUND OF THE INVENTION

1. Field of the Invention

The present invention relates to an antenna for a base station of mobile communication system, and in particular, to an antenna apparatus for a base station suitable for narrow service areas, or to an antenna apparatus for a relay station in dead zones.

2. Description of the Related Art

Antennas for the base stations of mobile communication systems are classified into base station antennas for the purpose of covering large-scale regions and base station antennas for the purpose of covering relatively limited, small-scale regions. The antennas for covering the small-scale area are used for covering so-called radio "dead zones" which are building shadow regions where radio waves are blocked by tall buildings. In metropolitan areas, since the radio dead zones are dispersed at relatively short distances, a concept known as a multi-hopping method has been considered, in which relay stations equipped with antennas covering small-scale regions are disposed at every radio dead zone and then the relay stations relay between one another in order to eliminate the dead zones.

Monopole antennas and dipole antennas are being used as base station antennas suitable for the radio dead zones or the narrow service areas. US Patent Publication No. 2005/0156804 A1 discloses designs for a radiation element of a monopole antenna with a finite ground plate. When such a monopole antenna is used at, for example, base stations for narrow service areas or relay stations using the multi-hopping method, the monopole antenna needs to be set up as a stand-alone antenna if the walls of the buildings cannot be used for the installation of the antenna.

FIGS. 8A and 8B are views illustrating a conventional monopole antenna being installed as a stand-alone type antenna, and characteristics thereof. In FIG. 8A, the monopole antenna 92 is arranged at a top end of an antenna support of the stand-alone type antenna standing on a ground plane 90, and is supplied with RF power through a feeding line 93 from a base station or relay station (not shown). Since a finite ground plate is arranged at the ceiling, a radiation pattern in the X-Z plane is characterized by a main lobe directed downward from a horizontal direction which is suitable for radiating radio waves toward valleys between buildings. FIG. 8B shows radiation pattern characteristics illustrating a radiation pattern in the X-Y plane of the installed monopole antenna 92. The monopole antenna 92 shows an omni-directional (all directional) radiation pattern in the shape of a circle, but the support 91 interferes with the radio waves, whereby attenuation of radio waves arises in −X direction, and the circular shape is distorted. This attenuation causes the deterioration of communication quality or communication failure, which makes it difficult to resolve the radio dead zones throughout all directions.

SUMMARY OF THE INVENTION

The present invention has been made to solve the above-mentioned problems occurring in the prior art, and the present invention provides an antenna apparatus, which removes dead directions, and at the same time, has a suppression means for easily suppressing the change of an antenna directivity pattern caused by the effect of a feed line or a radome and an improvement means for simply improving the Voltage Standing Wave Ratio (VSWR) deterioration caused by the effect of a reflector or the radome.

In accordance with an aspect of the present invention, there is provided an antenna apparatus. The antenna apparatus includes a sleeve antenna connected to a coaxial cable, the sleeve antenna including a central conductor and a sleeve, and a reflector in the shape of a cone. The sleeve antenna is arranged in a concave portion of the cone so that the central conductor is aligned with a central axis of the cone and a top end of the central conductor is separate from a vertex portion of the cone.

It is preferred that the antenna apparatus further includes an impedance matching disk arranged at the central conductor of the sleeve antenna and along the central axis of the cone.

It is preferred that the antenna apparatus further includes an interference suppression disk arranged at the coaxial cable of the sleeve antenna and along the central axis of the cone.

It is preferred that the antenna apparatus further includes a radome, the radome being made from a resinoid and in the shape of a cone, and a lower end of the reflector and a lower end of the radome closely approach each other to form a housing space therebetween, and the sleeve antenna is housed within the housing space.

It is preferred that the antenna apparatus further includes a radome, and the radome has a side surface in the shape of a cylinder and a top surface in the shape of a cone, when the reflector is arranged on the top surface of the radome, and the sleeve antenna is housed within the cylinder.

It is preferred that the reflector is made from metal plates, metal meshes or dielectric material coated with metals.

BRIEF DESCRIPTION OF THE DRAWINGS

The above and other aspects, features and advantages of the present invention will be more apparent from the following detailed description when taken in conjunction with the accompanying drawings, in which.

DETAILED DESCRIPTION OF THE EXEMPLARY EMBODIMENT

Figure 1:
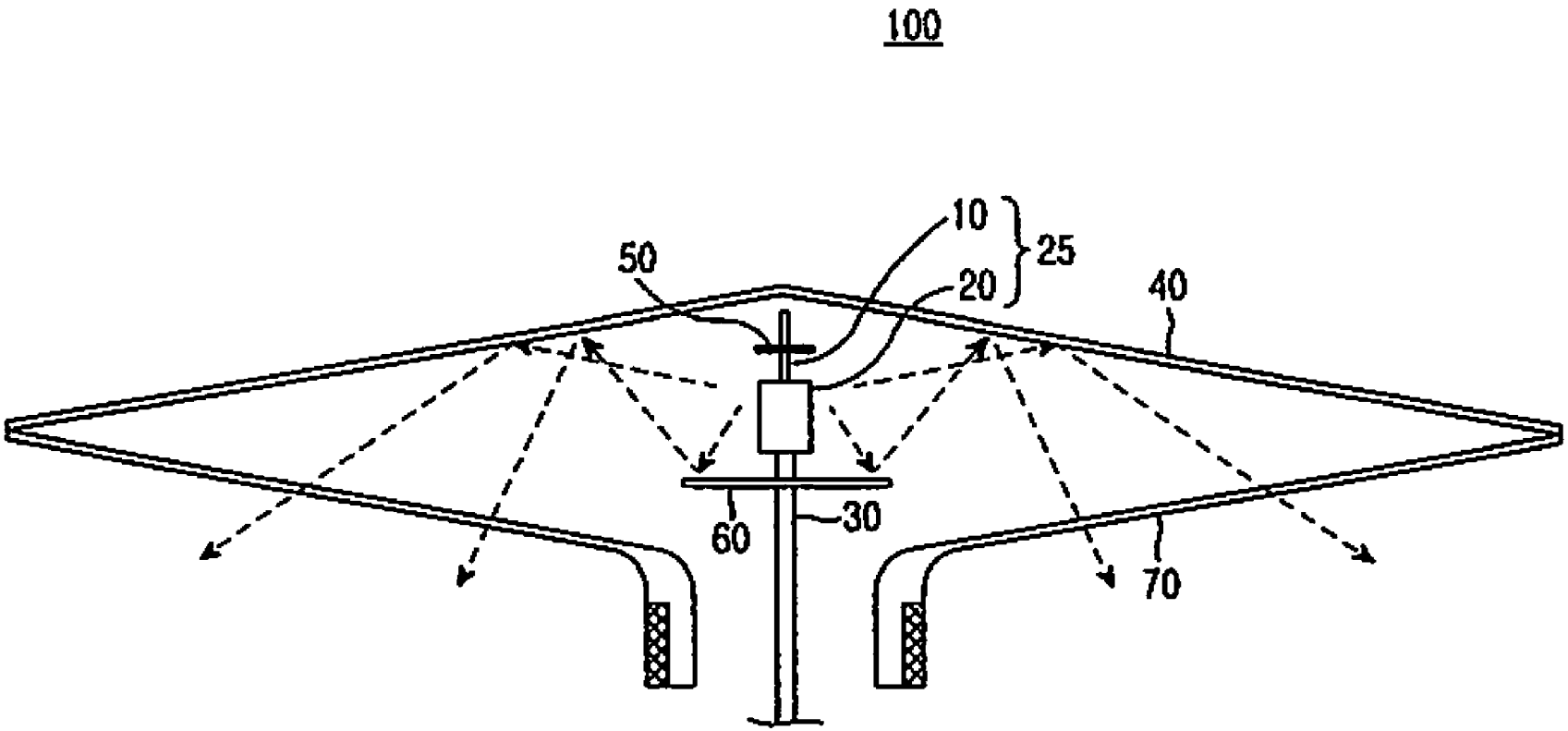
FIG. 1 is a view of an antenna configuration of an antenna apparatus of the present invention.

FIG. 1 is a view of an antenna configuration of an antenna apparatus of the present invention. A sleeve antenna 25 includes a central conductor 10 connected to a coaxial cable 30 supplied with RF power of radiation radio waves and a sleeve 20. Also, the antenna apparatus 100 includes the sleeve antenna 25, a reflector 40 in the shape of a cone, and a resinoid radome 70 in the shape of a cone, in which the sleeve antenna 25 is housed within a housing space formed by closely approaching a lower surface of the reflector 40 and a lower surface of the radome 70 to each other. The sleeve antenna 25 is arranged in a concave portion of the reflector 40 in such a manner that the central conductor 10 is aligned with the central axis of the cone and a top end of the central conductor 10 is separate from a vertex of the cone.

In addition, the antenna apparatus 100 includes, at the top end portion of the central conductor 10, an impedance matching disk 50 for improving VSWR deterioration caused by the effect of the reflection wave generated in the radome and specifically caused by the effect of a coupling generated by the approach of the central conductor 10 to the reflector 40. There is disposed, at the coaxial cable 30, an interference suppression disk 60 which prevents leakage current on the coaxial cable from flowing toward a connector of a transmitter (not shown), suppresses direct emission of radio waves from the top end of the cone shape of the radome 70 and the generation of large interference, and prevents an antenna support, if being in the shape of a pipe, from serving as a leakage waveguide. The impedance matching disk 50 and the interference suppression disk 60 allow the radio waves to efficiently radiate in the dashed line directions in FIG. 1, and allow the main lobe to be directed downward from the horizontal direction.

Next, the design for the antenna apparatus 100 will be explained. An open angle of the conical reflector 40 is 120° and the diameter of the conical reflector 40 is 3.75 λ. The diameter of the impedance matching disk 50 is about ⅛ λ. Also, the diameter of the interference suppression disk 60 is about ½ λ. Lengths of the central conductor 10 and sleeve 20 of the sleeve antenna 25 are ¼ λ, respectively. The distance from the upper end of the sleeve 20 to the interference suppression disk 60 is about ⅜ λ. The distance from the upper end of the sleeve 20 to the impedance matching disk 50 is about 1/16 λ. The distance from the reflector 40 to the impedance matching disk 50 is about 1/16 λ.

Figure 2A:
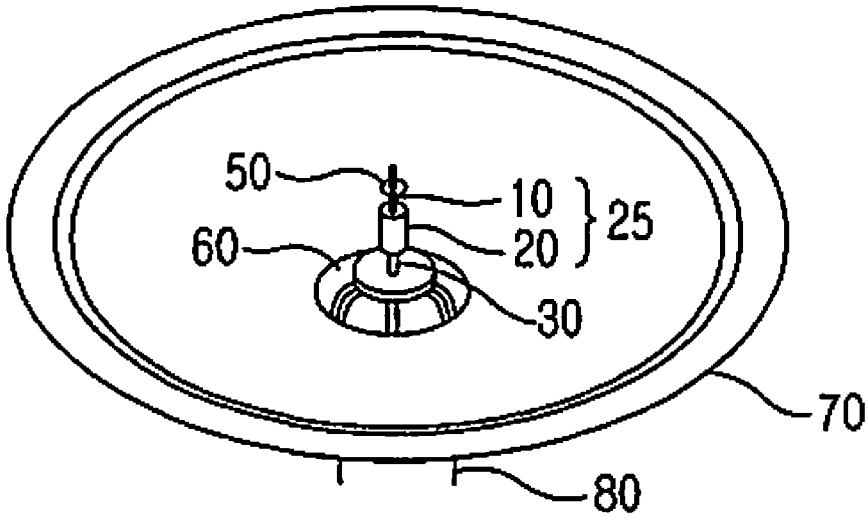
FIGS. 2A and 2B are internal installation views illustrating an internal installation configuration of the antenna apparatus of the present invention.
Figure 2B:
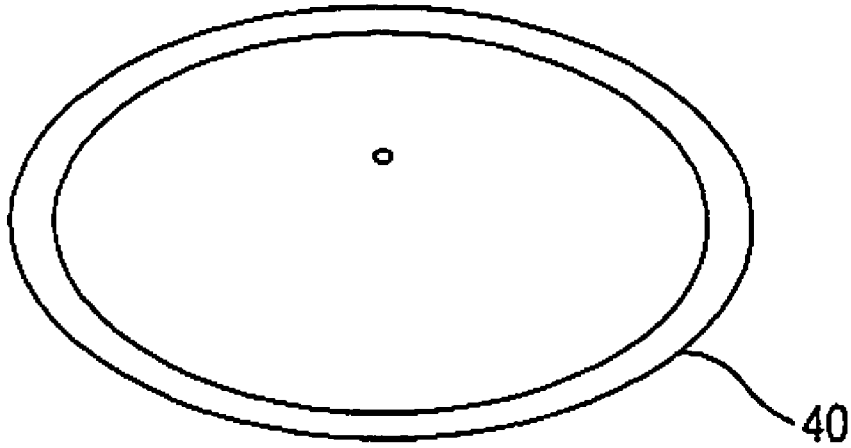

FIGS. 2A and 2B are internal installation views illustrating an internal installation configuration of the antenna apparatus of the present invention. As shown in FIG. 2A, the sleeve antenna 25 connected to the coaxial cable 30, the impedance matching disk 50 being a matching means, and the interference suppression disk 60 are inserted into a hole at the top end of the conical radome 70 and are fixed thereto. FIG. 2B is a view of the reflector 40. The lower surface of the reflector 40 and the lower surface of the radome 70 closely approach each other, thereby forming the antenna apparatus 100 before being installed on the antenna support 80.

Figure 3A:
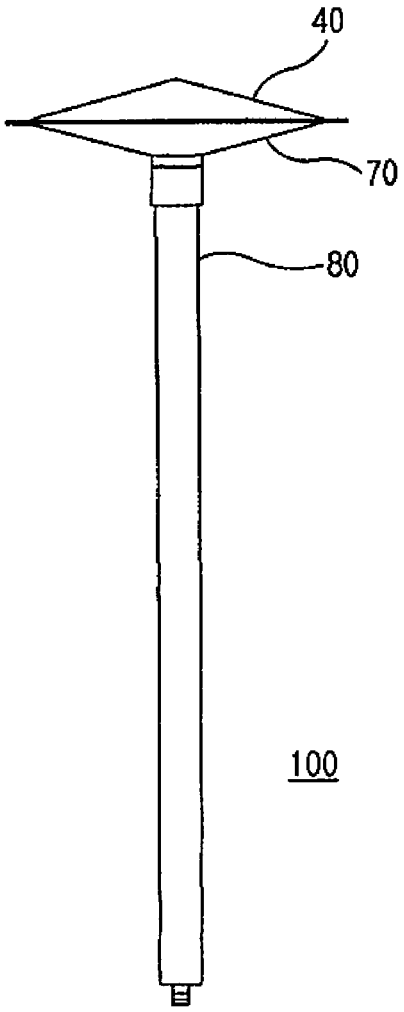
FIGS. 3A and 3B are external installation views illustrating an external installation configuration of the antenna apparatus of the present invention.
Figure 3B:
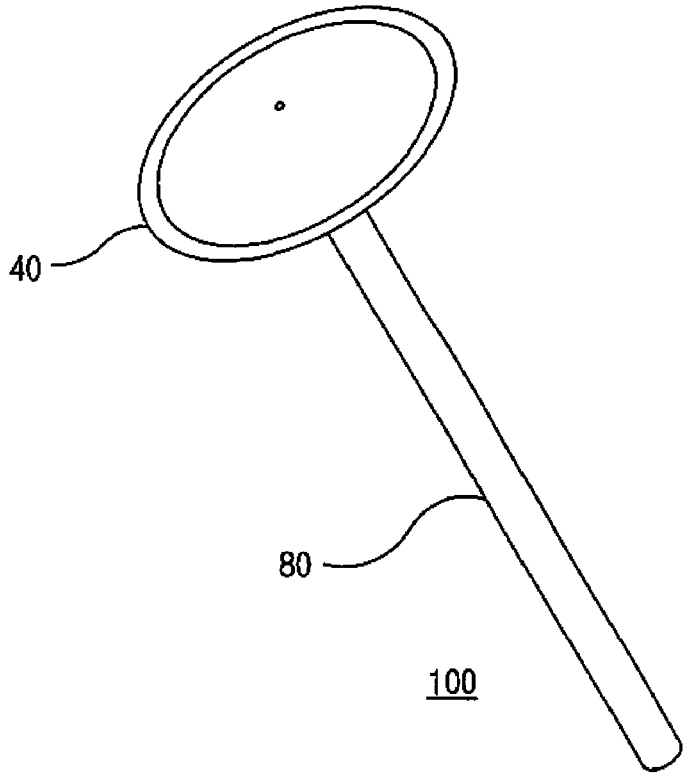

FIGS. 3A and 3B are external installation views illustrating an external installation configuration of the antenna apparatus of the present invention. As shown in FIG. 3A, the sleeve antenna 25 is housed within the housing space formed by closely approaching the lower surface of the reflector 40 and the upper surface of the radome 70 each other, thereby forming the antenna apparatus 100 installed to the antenna support 80. FIG. 3B is a perspective view of the antenna apparatus 100. This antenna apparatus 100 is installed as the stand alone antennas on the roofs of buildings or particular locations on the ground.

Figure 4:
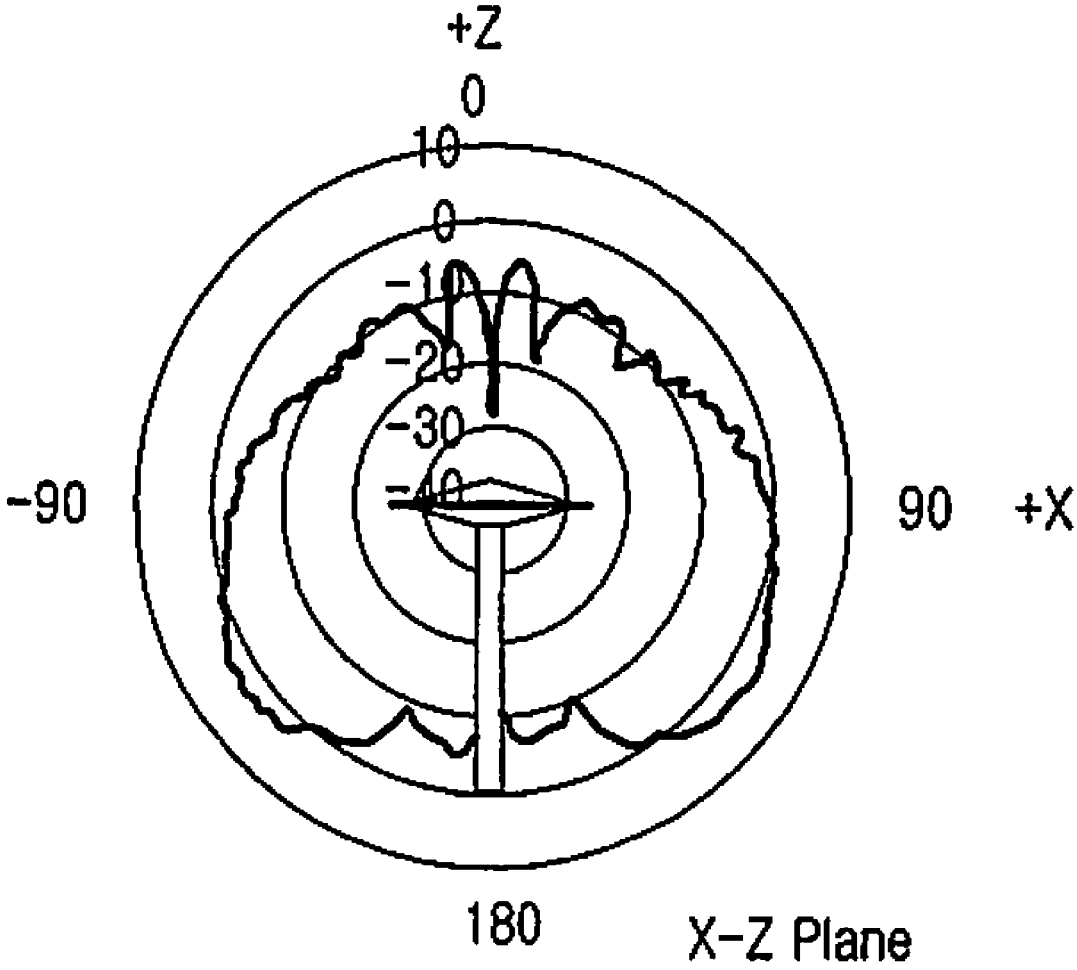
FIG. 4 is a view of directivity pattern characteristics illustrating directivity pattern in the X-Z plane of the antenna apparatus of the present invention.

FIG. 4 is a view of directivity pattern characteristics illustrating a directivity pattern in the X-Z plane of the antenna apparatus of the present invention. As shown in FIG. 4, the main lobe of the directivity pattern characteristics represents a pattern having a maximum gain in a stewed lower direction. In addition, since the antenna apparatus of the present invention as shown in FIGS. 3A and 3B is arranged at the top end of the antenna support 80, the antenna apparatus is not affected by the antenna support 80 and has a directivity pattern of an omni-directional pattern in the X-Y plane. Thereby, the radio dead zone due to the shadow of the antenna support is removed, which in turn removes the communication failure area.

Figure 5:
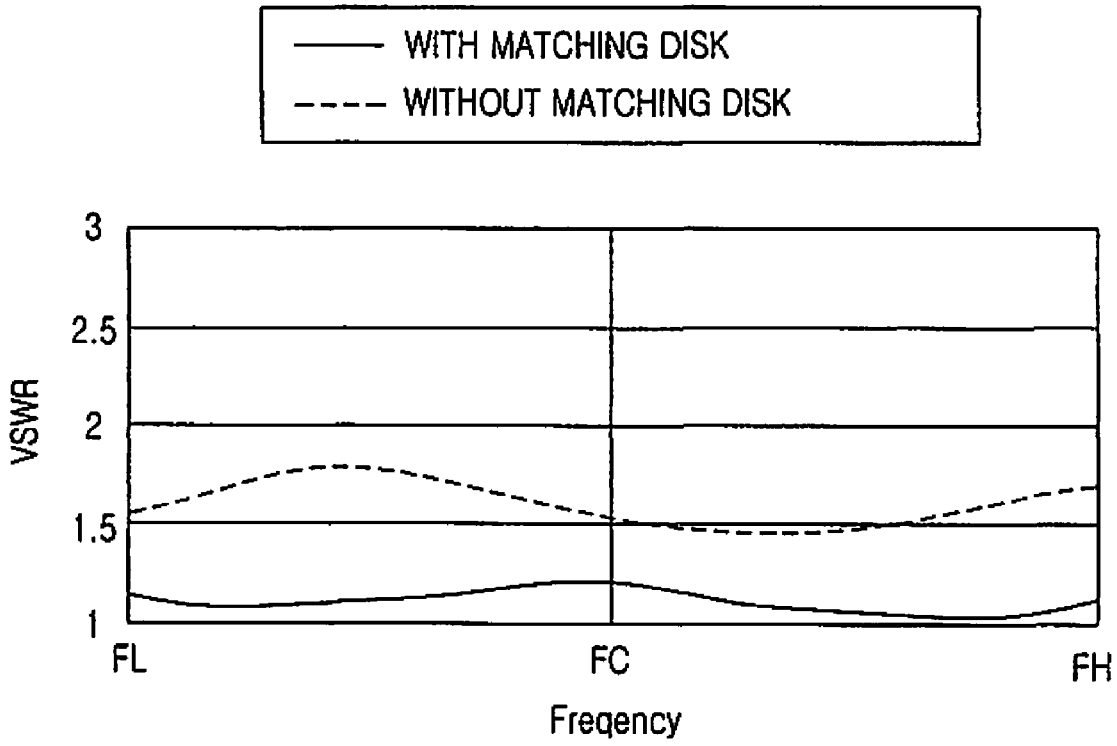
FIG. 5 is a view of VSWR characteristics of the antenna apparatus according to the present invention.

FIG. 5 shows VSWR characteristics illustrating the effect of the impedance matching disk according to the present invention. At the front end of the central conductor 10, the VSWR characteristics are deteriorated due to the effect of reflection waves generated in the radome and the effect of the coupling generated by the approach between the central conductor 10 and the reflector 40. A dashed line in FIG. 5 represents the case without the impedance matching disk, and a solid line in FIG. 5 represents the case with the impedance matching disk, respectively. Here, the VSWR is improved to 0.5~1.0. In addition, the VSWR is preferably less than 1.3 because either the base station antenna or the relay station antenna may transmit radio waves of relatively high power as well as receive radio waves, which can be sufficiently achieved by the effects of this disk.

Figure 6:
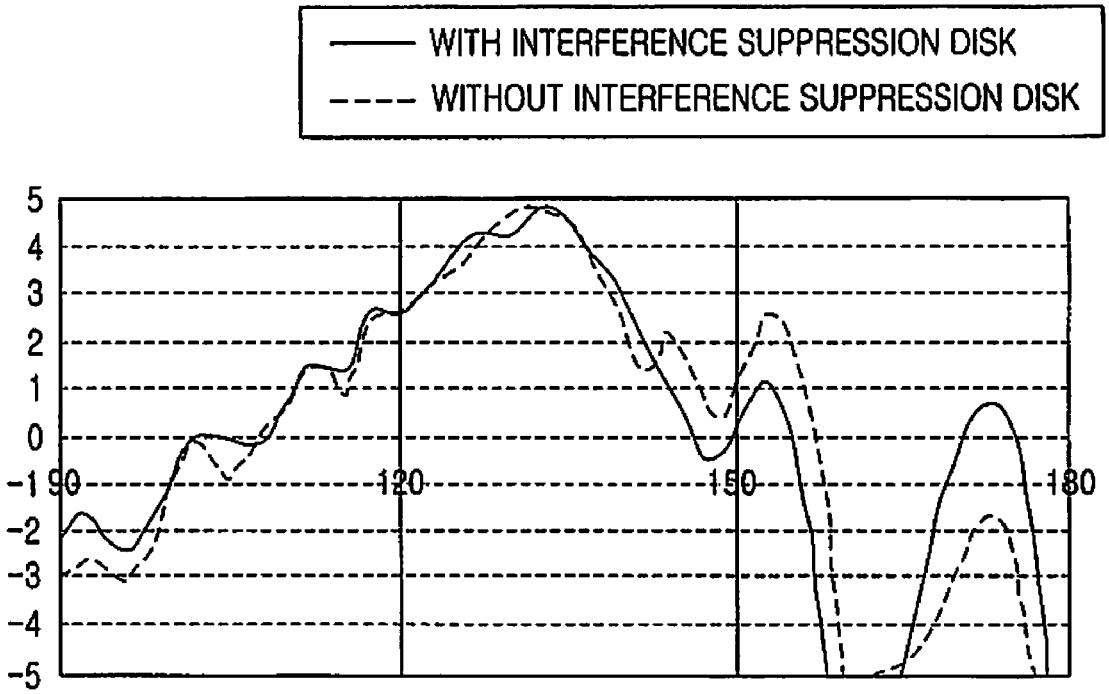
FIG. 6 is a view of ripple characteristics of the radiated radio waves of the antenna apparatus according to the present invention.

FIG. 6 shows ripple characteristics of the radiated radio waves, illustrating an effect of the interference suppression disk of the antenna apparatus according to the present invention. When the interference suppression disk 60 is not provided, interference waves are generated in the coaxial cable 30 due to the flow of leakage current on the coaxial cable 30, and direct radio waves are radiated at the front end of the radome 70 so that a large interference are generated. Furthermore, if the antenna support 80 to be connected is in the shape of a pipe, it serves as a leakage waveguide and interference waves are thus generated. The interference suppression disk 60 is provided to solve these problems. In FIG. 6, a dashed line represents the case without the interference suppression disk, and a solid line represents the case with the interference suppression disk, respectively. For the horizontal direction (90°), the main lobe is generated in the direction less than 45° (135°). In addition, radio waves are rapidly attenuated in the direction less than 70°, and scarcely generated in the direction of 90° which is the direction of the antenna support 80. The vertical axis is drawn on a scale of dBi. A ripple due to interferences is suppressed by the interference suppression disk 60, and ripple characteristics have a gently curved pattern.

Figure 7:
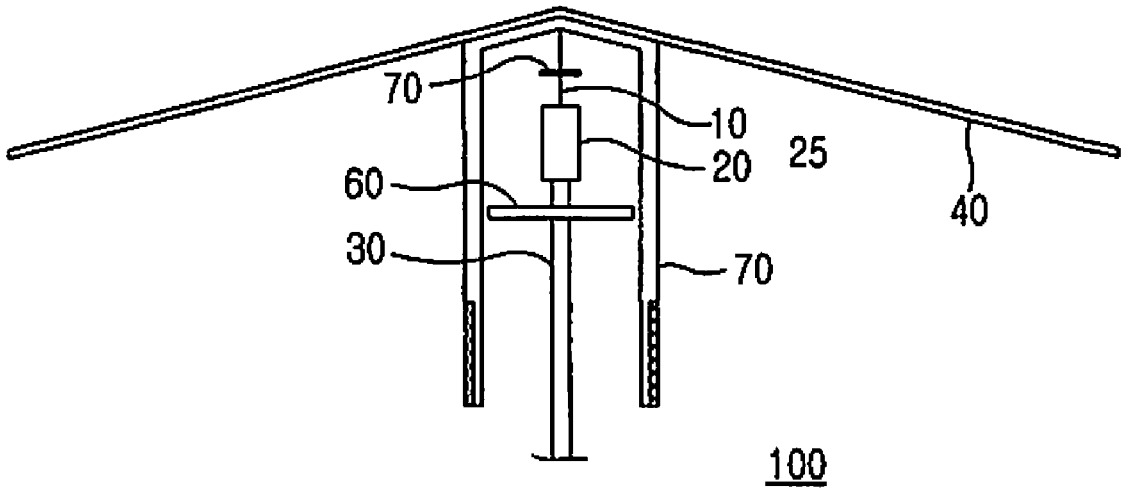
FIG. 7 is a view of an antenna configuration of an antenna apparatus according to another embodiment of the present invention.
Figure 8A:
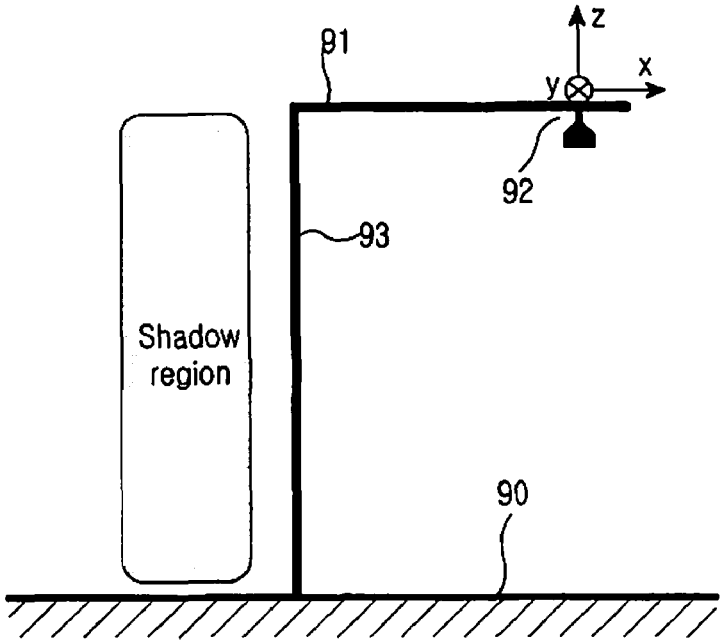
FIG.8A (PRIOR ART)
FIGS. 8A and 8B are views illustrating an installation structure of a conventional monopole antenna and its characteristics.
Figure 8B:
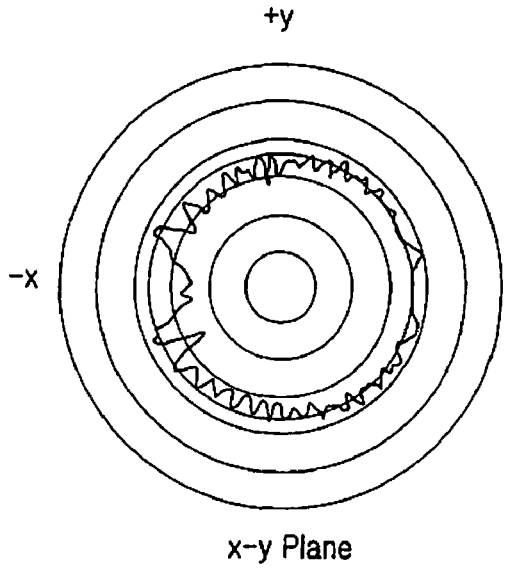
FIG.8B (PRIOR ART)

FIG. 7 is a view of a configuration of an antenna apparatus according to another embodiment of the present invention. As shown in FIG. 7, the antenna apparatus according to another embodiment of present invention includes a sleeve antenna 25 connected to a coaxial cable 30, an impedance matching disk 50 being a matching means, an interference suppression disk 60, and a radome 70 having a side surface in the shape of a cylinder and a top surface in the shape of a cone, in which the impedance matching disk 50 and the interference suppression disk 60 are inserted into and fixed to the inside of the radome 70. A reflector 40 is arranged at the top surface of the radome 70. The configuration in FIG. 7 is an antenna apparatus 100 before being installed to an antenna support 80. This simple structure of the antenna apparatus 100 can cover dead zones in indoor area where wind pressure is low. In addition, the reflector 40 shown in FIGS. 1 and 7 may be made from metal plates, metal meshes or dielectric material coated with metals.

According to the present invention as described above, it is possible to provide the antenna apparatus, which suppresses interference with the antenna support, and thus removes the dead zones, and has the suppression means for easily suppressing the change of the antenna directivity pattern caused by the effect of the feed line or the radome and the improvement means for simply improving the VSWR deterioration caused by the effect of the reflector or the radome. Accordingly, the antenna apparatus can be used as relay station antennas which relay the radio waves in the skewed lower direction toward the so-called radio dead zones by installing it at the height capable of avoiding obstacles.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. An antenna apparatus comprising:

a sleeve antenna connected to a coaxial cable, the sleeve antenna including a central conductor and a sleeve;

a reflector having a cone shape;

an impedance matching disk arranged at the central conductor of the sleeve antenna and along the central axis of the reflector; and an interference suppression disk arranged at the coaxial cable of the sleeve antenna and along the central axis of the reflector, wherein the sleeve antenna is arranged in a concave portion of the reflector, the central conductor is aligned with a central axis of the reflector, and a top end of the central conductor is separate from a vertex portion of the reflector.

2. The antenna apparatus as claimed in claim 1, further comprising a radome, the radome being made from a resinoid and having a cone shape, wherein a lower end of the reflector and a lower end of the radome closely approach each other to form a housing space therebetween, and the sleeve antenna is housed within the housing space.

3. The antenna apparatus as claimed in claim 1, further comprising a radome, the radome being made from a resinoid and having a cone shape, wherein a lower end of the reflector and a lower end of the radome closely approach each other to form a housing space therebetween, and the sleeve antenna is housed within the housing space.

4. The antenna apparatus as claimed in claim 1, further comprising a radome, the radome being made from a resinoid and having a cone shape, wherein a lower end of the reflector and a lower end of the radome closely approach each other to form a housing space therebetween, and the sleeve antenna is housed within the housing space.

5. The antenna apparatus as claimed in claim 1, further comprising a radome, the radome having a side surface in a cylinder shape and a top surface in a cone shape, wherein the reflector is arranged on the top surface of the radome, and the sleeve antenna is housed within the cylinder.

6. The antenna apparatus as claimed in claim 1, further comprising a radome, the radome having a side surface in a cylinder shape and a top surface in a cone shape, wherein the reflector is arranged on the top surface of the radome, and the sleeve antenna is housed within the cylinder.

7. The antenna apparatus as claimed in claim 1, further comprising a radome, the radome having a side surface in a cylinder shape and a top surface in a cone shape, wherein the reflector is arranged on the top surface of the radome, and the sleeve antenna is housed within the cylinder.

8. The antenna apparatus as claimed in claim 1, wherein the reflector is made from a material selected from the group consisting of metal plates, metal meshes and dielectric material coated with metals.

9. The antenna apparatus as claimed in claim 1, wherein the reflector is made from a material selected from the group consisting of metal plates, metal meshes and dielectric material coated with metals.

10. The antenna apparatus as claimed in claim 1, wherein the reflector is made from a material selected from the group consisting of metal plates, metal meshes and dielectric material coated with metals.

* * * * *